United States Patent [19]

Cox

[11] Patent Number: 4,576,254

[45] Date of Patent: Mar. 18, 1986

[54] HYDRAULICALLY ACTUATED SLIP ASSEMBLY

[75] Inventor: Don C. Cox, Roanoke, Tex.

[73] Assignee: Otis Engineering Corporation, Dallas, Tex.

[21] Appl. No.: 577,015

[22] Filed: Feb. 6, 1984

[51] Int. Cl.[4] ..... B23Q 5/033

[52] U.S. Cl. ..... 188/67; 81/57.18; 279/4; 279/71; 279/114

[58] Field of Search ..... 81/57.18, 57.19; 279/4, 279/1 TE, 28, 71, 114; 188/67, 265; 70/181; 74/531; 294/102.2; 226/149, 150

[56] References Cited

U.S. PATENT DOCUMENTS

| | | | |
|---|---|---|---|
| 711,911 | 10/1902 | Smith | 279/28 |
| 3,422,506 | 1/1969 | Turner, Jr. | 188/67 |
| 3,507,174 | 4/1970 | Dickmann | 81/57.18 |
| 3,760,469 | 9/1973 | Brown | 81/57.18 |
| 4,269,277 | 5/1981 | Baugh | 173/149 |
| 4,296,658 | 10/1981 | Champeau et al. | 279/4 |
| 4,478,292 | 10/1984 | Baugh et al. | 173/149 |

FOREIGN PATENT DOCUMENTS

| | | | |
|---|---|---|---|
| 2025491 | 12/1971 | Fed. Rep. of Germany | 279/114 |

*Primary Examiner*—Duane A. Reger
*Assistant Examiner*—Richard R. Diefendorf
*Attorney, Agent, or Firm*—Roland O. Cox

[57] ABSTRACT

A hydraulically operated slip assembly, connectible to a well head or well pipe handling machine and useful to intermittently grip pipe being run into or pulled from the well. The slip assembly has upper and lower plates with passages for pipe. Wedges, carrying unique slip systems, are positioned around the passages and slidably mounted for radial movement between guide plates extending from the upper and lower plates. The wedges are moved radially inward to grip pipe and radially outward to release pipe by a hydraulic cylinder, pivotally mounted aside the lower plate. When actuated to extend, the hydraulic cylinder rotates an inner bearing race and attached camming segments, which move the wedges inwardly to grip pipe. When the cylinder is actuated to contract, the bearing race and camming segments are rotated to pull the wedges outward radially, releasing pipe. The bearing outer race is housed in ring segments between and connecting the slip assembly upper and lower plates. The unique slip systems automatically increase pipe grip, on up or down movement of gripped pipe caused by very small loads. Outward force components, resulting from increased pipe grip, press the outer surfaces of the camming segments into ring segment grooves, developing forces which effectively prevent inadvertent or an purpose actuation of the cylinder from rotating the camming segments to ungrip pipe in the slip assembly.

18 Claims, 9 Drawing Figures

FIG. 4
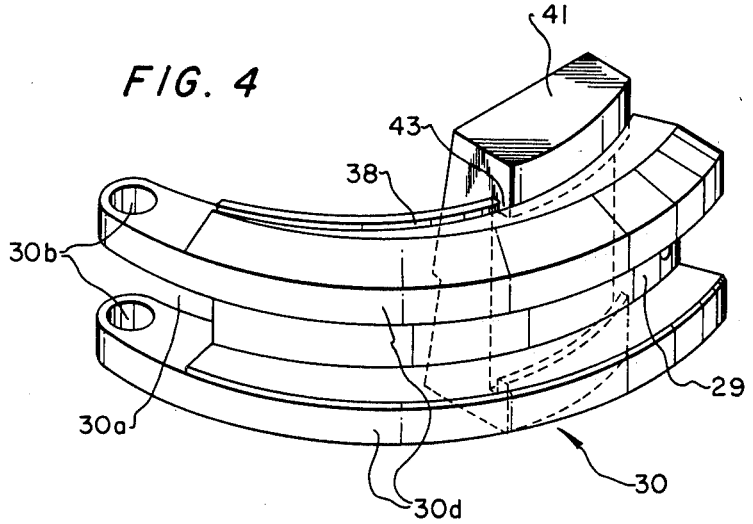
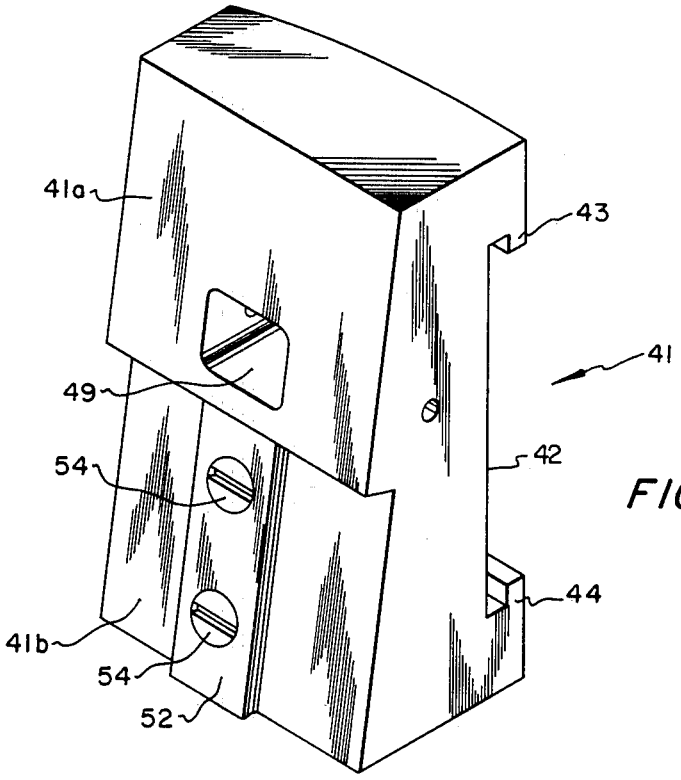
FIG. 7

HYDRAULICALLY ACTUATED SLIP ASSEMBLY

BACKGROUND

This invention relates to an improved hydraulically actuated "double acting" slip assembly, useful to intermittently grip well pipes and tubing and prevent axial movement while the pipe is being run into or pulled from a well through the slip assembly.

A double acting slip assembly of this type is a very useful part of well pipe handling machines and drilling and servicing equipment generally known as hydraulic workover or "snubbing" units, used to run and pull well pipes while maintaining pressure control of the well to prevent "blowouts" and "wild wells".

A double acting slip assembly, when actuated to grip pipe, will prevent internal well pressure from pushing the pipe up and out of the well or support the weight of pipe tending to fall into the well.

A double acting slip assembly is disclosed in U.S. Pat. No. 3,760,469 to Cicero C. Brown which utilizes slip segments moved radially to initially grip the pipe. The radial movement can be easily reversed while there is an axial pipe load on this slip assembly, resulting in inadvertent release of pipe to fall into or be blown from a well.

A double acting slip assembly structure is also disclosed in U.S. Pat. No. 4,269,277 to Benton F. Baugh, herein incorporated by reference. The Baugh structure includes friction plates which are pressed together by pipe movement, after gripping, to frictionally oppose rotation of a drive sleeve in a direction releasing the pipe. Both the Brown and Baugh devices may be power rotated to turn gripped pipe and use two or more hydraulic cylinders for operation.

SUMMARY OF THE INVENTION

The hydraulically actuated slip assembly of this invention includes wedges carrying double acting slips, which are moved radially inwardly and outwardly to grip pipe by rotating camming ring segments, pivotally connected in the inner race of a ring bearing, which is supported in ring segments equally spaced around the bearing. The camming ring segments are grooved top and bottom and are slidably connected to the outside of the slip wedges by engaging the grooves in a "T" slot in the outside of each wedge. The bearing supporting ring segments are mounted between slip assembly upper and lower near triangular plates. The bottom plate has an appropriate lower connection for connection to a workover unit and one hydraulic cylinder assembly is pivotally connected along one side. Both top and bottom plates have a central opening for the passage of pipe.

The upper surface of the lower plate and the lower surface of the upper plate have pairs of vertical guide plates. Each parallel pair of plates is spaced equally around the opening and aligned with a ring segment to position and guide the slip wedges when moved radially in or out by rotation of the ring bearing inner race and attached camming ring segments. The guide plate pairs also prevent rotation of the slip wedges.

The piston rod extending from the hydraulic actuator is pivotally connected to an operating link with a pin. The other end of the link is pivotally connected with a pin to a camming ring segment and the inner bearing race. Other camming segments are pivotally connected to the inner race. To move the slip wedges in to grip pipe, the hydraulic cylinder is pressured to move the piston out of the cylinder and rotate the bearing inner race, sliding the thicker portions of the camming segments between the slip wedges and ring segments.

Each wedge carries a double acting slip system with an insert having teeth on its inner surface which grip the outside of the pipe on contact. Each slip system is spring loaded to an outward position for gripping pipe. These slip systems are designed so that any up or down load on gripped pipe, sufficient to overcome their loading springs, will cause axial movement of the pipe and automatic inward movement of the gripping inserts, resulting in more tightly gripped pipe.

The invention slip assembly includes a grip locking system which prevents even a pressured hydraulic cylinder from rotating the ring bearing inner race and camming segments to move the slip wedges outwardly and prematurely or inadvertently release the gripped pipe when there is a very minimal axial pipe load on the gripping slip inserts. The horizontal outward force components resulting from inward movement of the slips along the secondary wedges to grip pipe tighter are transmitted through the wedges and press outer camming segment surfaces against internal ring segment surfaces. The frictional forces between the contacting camming segment and ring segment surfaces are greater than the releasing rotating forces imparted to the camming segments by the pressured hydraulic cylinder, and the camming segments cannot be rotated to move the slip wedges outwardly and release the pipe.

A principal object of this invention is to provide an improved double acting slip assembly which when minimally loaded cannot release gripped pipe.

An object of this invention is to provide an improved hydraulic slip assembly utilizing unique double acting slip system structures to automatically grip pipe tighter.

Another object of this invention is to provide an improved hydraulic slip assembly which occupies very little vertical space.

Also an object of this invention is to provide an improved hydraulic slip assembly requiring only one hydraulic cylinder for operation.

DRAWING DESCRIPTION

FIG. 4 is an isometric drawing showing the slidable connection between a slip assembly wedge and camming ring segment.

FIG. 7 is an isometric drawing of the wedge utilized in this invention with dovetail attached.

DESCRIPTION OF THE PREFERRED EMBODIMENT

Figure 1:
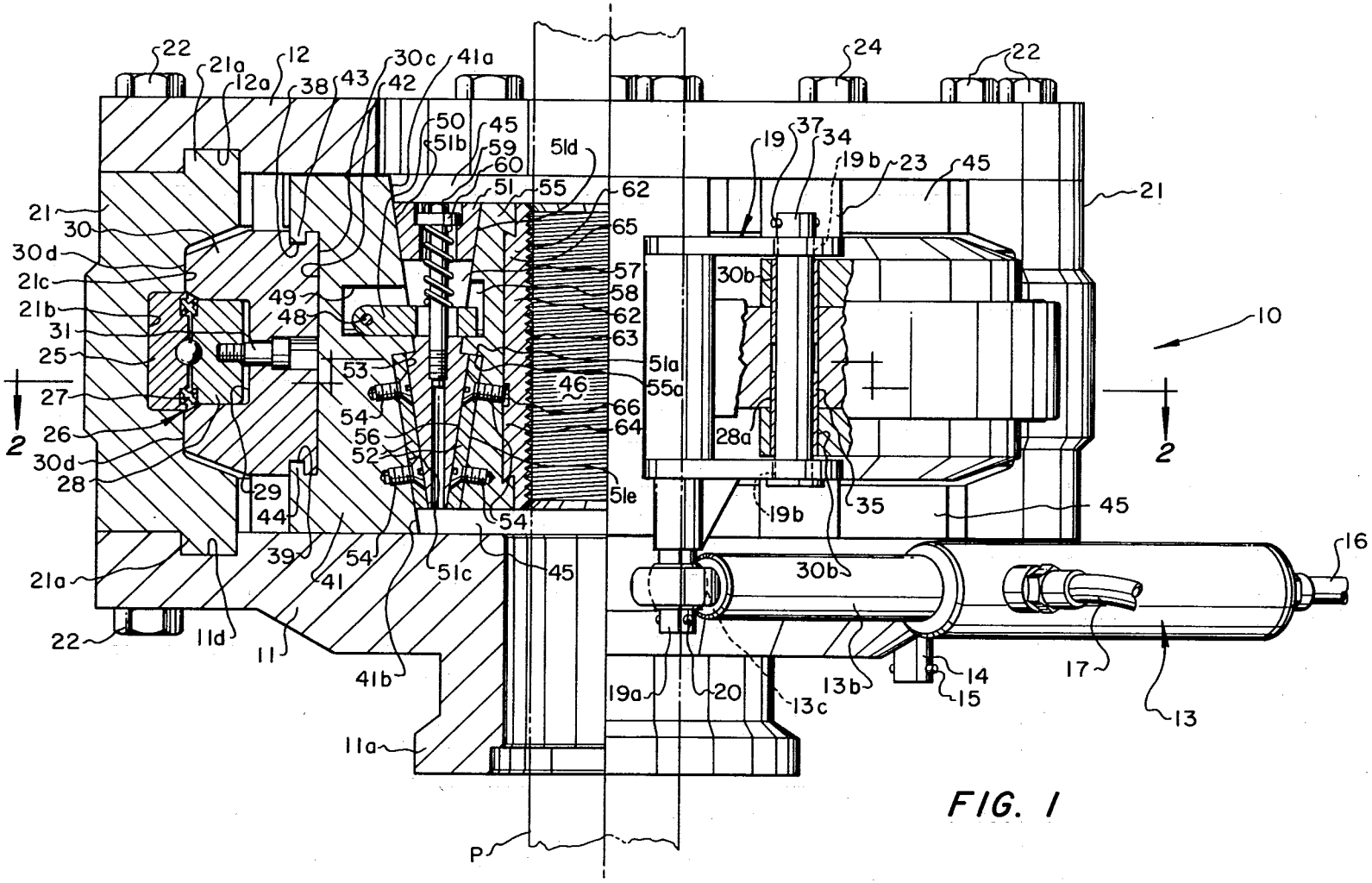
FIG. 1 is a half section elevation drawing of the slip assembly of this invention.
Figure 2:
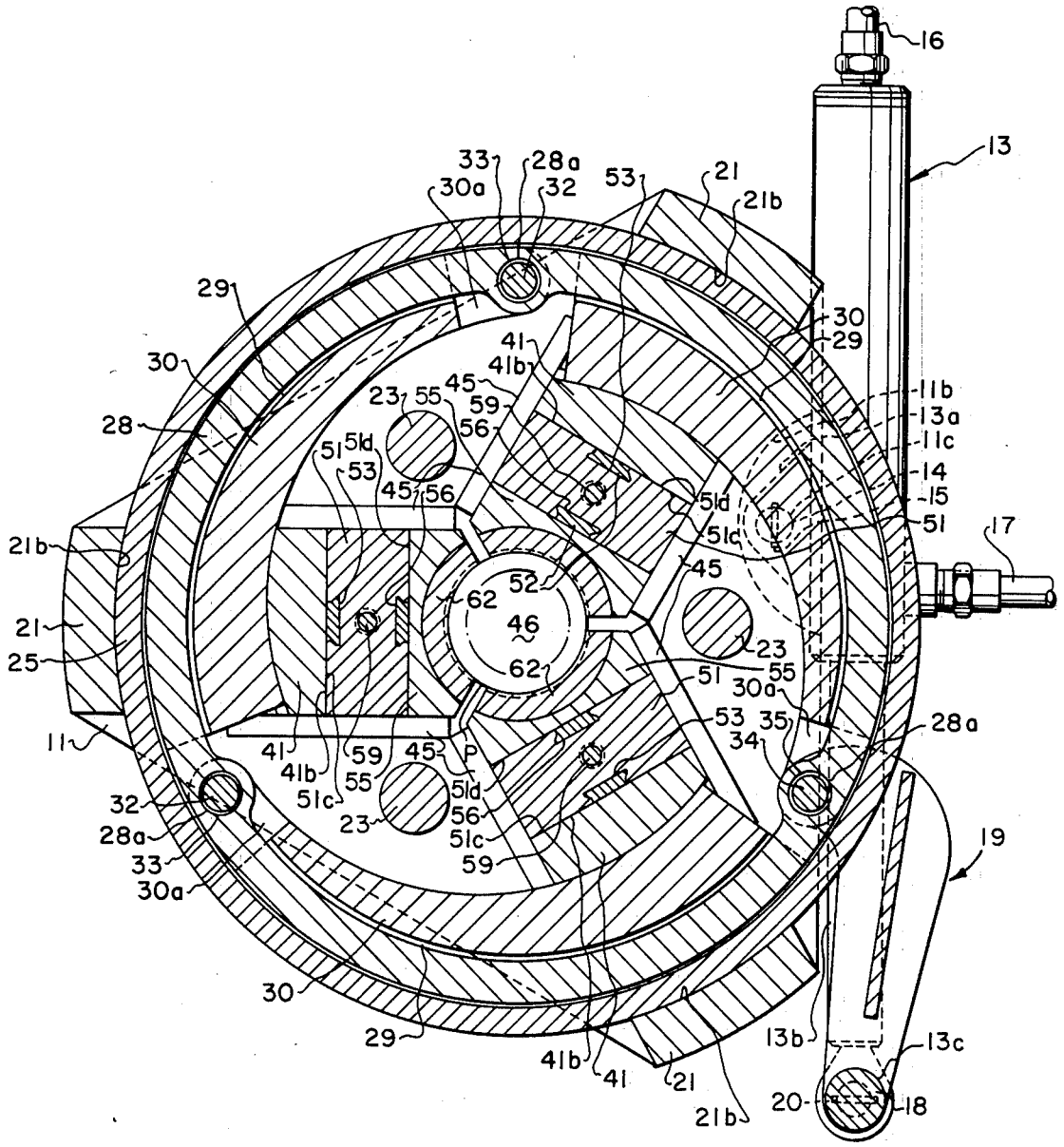
FIG. 2 is a drawing of a cross section, along line 2—2 of FIG. 1, showing the slip assembly actuated to grip pipe.

Referring now to FIGS. 1 and 2, these Figures show the preferred embodiment of slip assembly 10 of this invention having a lower plate 11 and an upper plate 12. The lower plate has an appropriate connector 11*a* for connecting the lower plate and slip assembly to a well head or pipe handling workover unit. Pivotally mounted in a slot 11*b* in the lower plate is a hydraulic piston/cylinder actuator 13. The actuator is attached in the bottom plate slot by a pin 14 passed through hole 11*c* in the lower plate and actuator tab 13*a*. The pin is retained in the hole by drive pins 15.

Connected to the actuator are conduits 16 and 17, useful in conducting remotely pressured fluids into and from the actuator for operation of the slip assembly.

The actuator has a piston rod 13*b* having a hole 13*c* in which is mounted a bearing 18. An operating link 19 has an extended rod portion 19*a* which is inserted through a hole in the bearing, pivotally connecting the operating link and actuator. The connection is secured by drive pin 20.

Mounted between top and bottom plates are three identical ring segments 21, spaced 120 degrees apart and radially positioned by upper and lower extended portions 21*a* protruding into mating grooves 11*d* and 12*a* in the lower and upper plates, with pairs of top and bottom bolts 22 passing through holes in the top and bottom plates and screwed into internally threaded holes in each ring segment, fastening each ring segment to the top and bottom plates. Spacing apart and also fastening the top and bottom plates together are rods 23 and bolts 24.

Each ring segment 21 has a large radial groove 21*b* and a small radial wider groove 21*c* cut inside. Housed in the large inside segment grooves is an outer bearing race 25 of sealed ring bearing 26, having seals 27 and an inner race 28. The inner race has three holes 28*a* spaced 120 degrees apart and is housed in grooves 29 in the outside surfaces of three camming segments 30 (see FIG. 4). Three screws 31 threadedly connect each camming segment to the bearing inner race. Each camming segment is provided with a slot 30*a* through its thin end and a cross hole 30*b*. Each camming segment has an inner curved surface 30*c* and an outer curved surface 30*d*. Two of the camming segments are pivotally connected to the bearing inner race by pins 32, surrounded by bushings 33, which are passed through holes 30*b* in the camming segments and two holes 28*a* spaced 120 degrees apart in the bearing race. A longer pin 34 surrounded by bushing 35 is passed through holes 19*b* in the operating link, 30*b* in the third camming segment and the remaining hole 28*a* in the inner bearing race connecting the link, camming segment and inner race. Pins 32 and 34 are prevented from disconnecting by drive pins 37.

Each camming segment has an upper radial groove 38 and a lower radial groove 39 spaced from and concentric with the inner curved surface 30*c* of each camming segment. Cut across the outer surface of each wedge 41, FIG. 7, is a "T" slot 42 having inward extentions 43 and 44, which are slidably engageable in camming segment slots 38 and 39 to slidably connect each camming segment to each wedge, as shown in FIG. 4. Each wedge is provided with downwardly and inwardly inclined surfaces 41*a* and 41*b*.

Projecting downwardly from the upper plate and upwardly from the lower plate are three pairs of integral guide plates 45. Each pair of parallel guide plates is spaced 120 degrees apart around pipe passage 46 and aligned with a ring segment. Radially movable wedges 41 are slidably mounted between each pair of guide plates.

Figure 8:
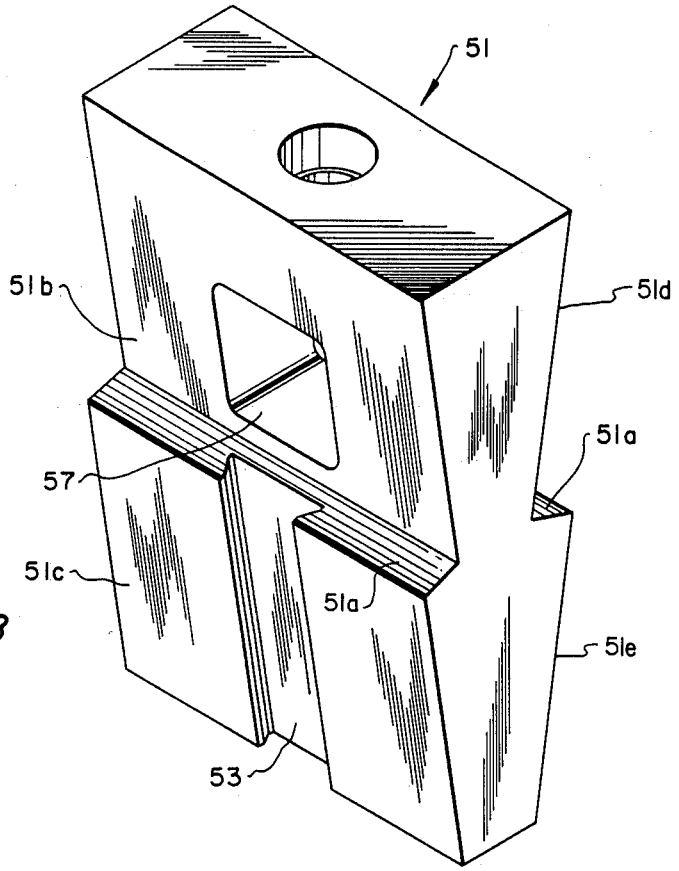
FIG. 8 is an isometric drawing of the slip assembly secondary wedge.

Pivotally connected by pin 48 in a hole 49 in each wedge is a bar 50. Slidably securing the secondary wedges 51 (FIG. 8) to each wedge are dovetails 52 (FIG. 7), engaged in a mating groove 53 in each secondary wedge and fastened to each wedge with screws 54. The secondary wedges have upwardly facing shoulders 51*a* and downwardly and inwardly inclined stepped surfaces 51*b* and 51*c* and downwardly and outwardly inclined stepped surfaces 51*d* and 51*e*.

Figure 9:
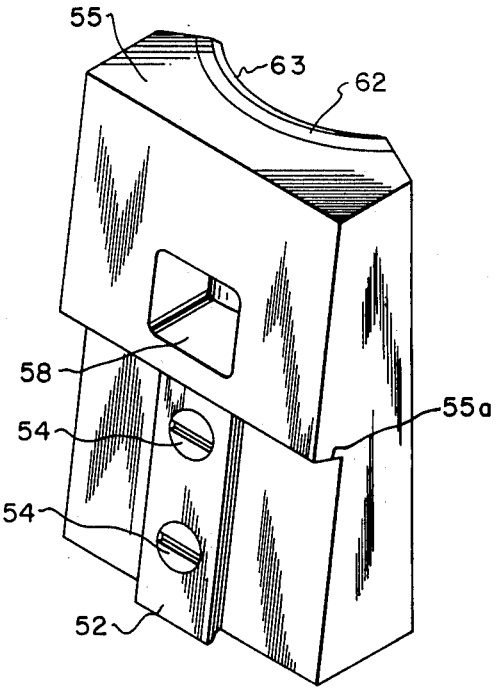
FIG. 9 is an isometric drawing of a slip, with dovetail attached, utilized in this invention.

In a like manner, a slip 55 is slidably connected to the inner side of each secondary wedge by more dovetails 52 engaged in mating grooves 56 in the secondary wedges and fastened to each slip with more screws 54 as shown in FIG. 9. Each slip is provided with a downwardly facing shoulder 55*a*. Each secondary wedge has a cross hole 57 for bar 50, and each slip has a hole 58 into which the bar protrudes. Threadedly fastened to each secondary wedge is a bolt 59 which passes through a washer 60, a compressed spring 61 and a hole through the bar. The spring is compressed enough to maintain the secondary wedge and slip connected in each wedge in an up position, as shown in FIG. 1, so that the lower side of cross hole 57 in the secondary wedge and the lower side of hole 58 in the slip are contacting the lower side of bar 50. Each slip carries a cylindrical segment insert 62 having teeth 63 on the inner surface for gripping pipe and a male dovetail portion 64 extending from the outer surface. Each insert is connected to its respective slip by engaging extending insert dovetail 64 in a mating groove 65 in each slip and sliding into proper position. Each insert is retained in position by a screw 54 protruding into a hole 66 in each insert.

Figure 3:
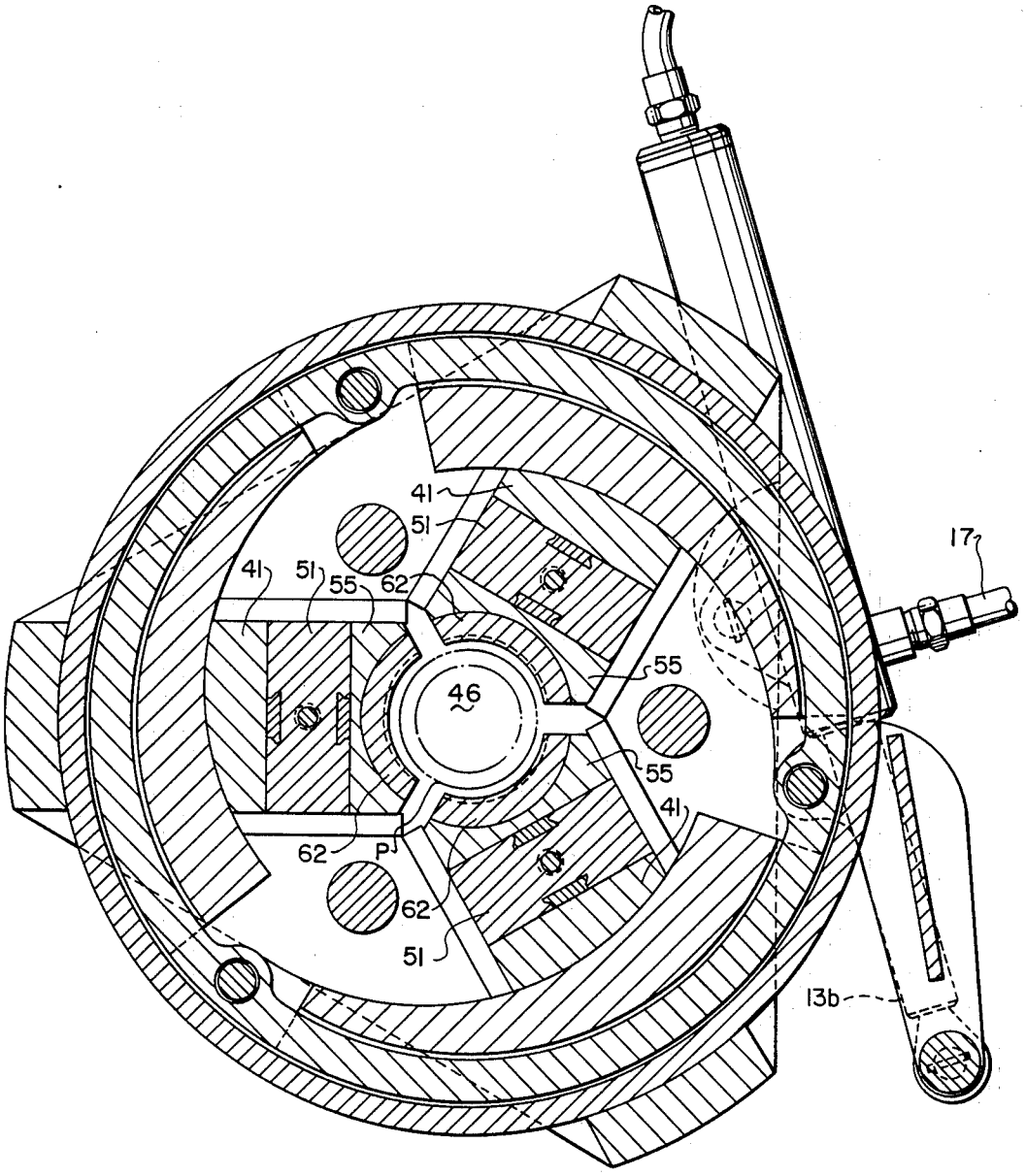
FIG. 3 is a drawing of a cross section, similar to FIG. 2, showing the slip assembly actuated not to grip pipe.

To utilize the hydraulically operated slip assembly of this invention, the assembly is connected to a well head or into a well pipe handling machine with connector 11*a*. Conduits 16 and 17 are connected to a remote pressure source such that pressure fluid may be selectively delivered to the hydraulic actuator through either conduit. Conduit 17 should be pressured to move the wedges 41 and 51 and slips 55 with inserts 62 radially outward to pipe released position, as shown in FIG. 3. Well pipe P, to be gripped intermittently as it is run into or pulled from the well, is passed through pipe passage 46.

To operate the slip assembly when it is necessary to grip pipe, pressured fluid is delivered through conduit 16 causing extention of the piston rod from hydraulic actuator 13 and movement of pivotally connected operating link 19. As the other end of operating link 19 is pivotally connected to one of three camming segments 30 and the inner bearing race with pin 34, movement of the link causes rotation of pin 34 and the inner bearing race. The two other camming segments pivotally connected to the inner bearing race with pins 32 also rotate with the inner bearing race. Wedges 41, carrying secondary wedges 51 and slips 55, are slidably positioned between upper and lower guide plates 45 which prevent wedge rotation. If the inner bearing race and connected camming segments are rotated clockwise by extension of the actuator piston rod, the camming segments slide across the outer side of each wedge 41 through the "T"

slot connections, moving a thicker portion of each camming segment between each wedge and each ring segment groove 21*c*, the wedges are pushed radially inwardly until teeth 63 contact and grip pipe as shown in FIG. 2. Inward wedge push and pipe grip is maintained by pressured fluid in conduit 16 applying turning force to the camming segments through the actuator, link and bearing race. If opposite camming segment rotation slides a thinner camming segment section between the wedges and ring segment grooves, each wedge is pulled radially outward through the "T" slot connections as the camming segments are connected to the bearing inner race by screws 31, and pipe is released and passage 46 is enlarged for easy pipe passage as shown in FIG. 3.

When the slip assembly has been actuated to grip pipe, the thicker sections of the camming segments are compressed between the wedges and ring segments behind so that the outer wedge surfaces 42 bear on the inner curved surfaces 30*c* on the camming segments and the outer curved camming surfaces 30*d* bear on the bottom of ring segment grooves 21*c*.

Figure 5:
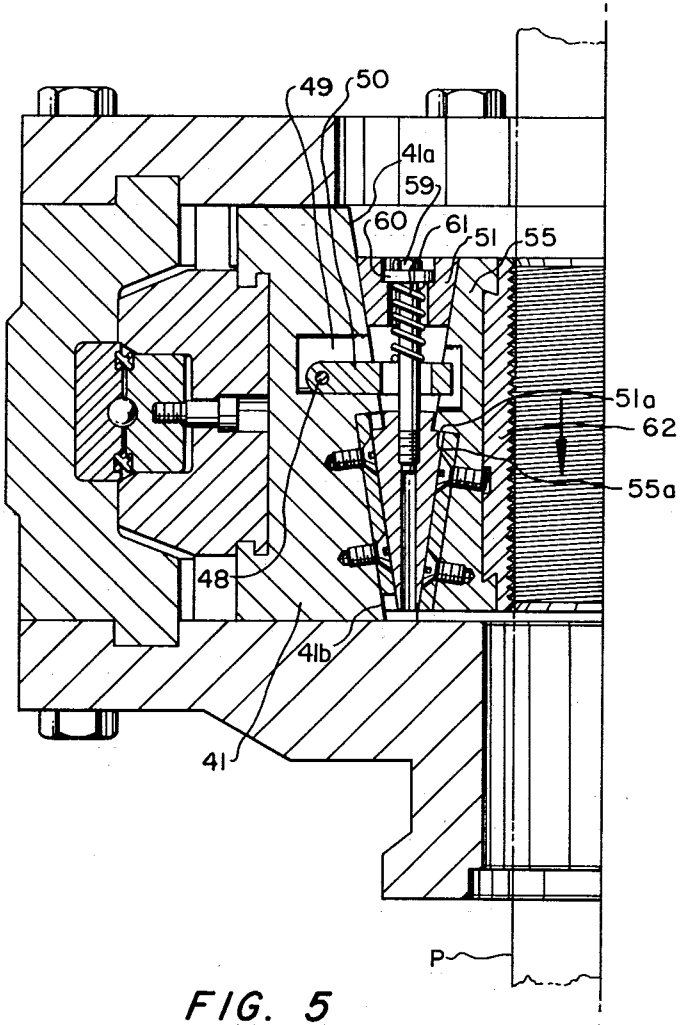
FIG. 5 is a sectioned drawing in elevation, showing wedge-slip cooperation tightening pipe grip as a result of pipe load down on the slip assembly.

The double acting grip tightening slip systems carried between each wedge and slip insert are actuated automatically by axial movement of gripped pipe. A small weight of gripped pipe sufficient to cause downward movement of insert 62 and slip 55 will also move secondary wedge 51 down through contacting shoulders 55*a* and 51*a* and pull bolts 59 and washers 60 downwardly, compressing spring 61. Any downward movement of the secondary wedges along wedge inclined surfaces 41*a* and 41*b* results in inward movement of the secondary wedge, slip and insert, causing deeper penetration of teeth 63 into the gripped pipe, increasing pipe grip as shown in FIG. 5.

Figure 6:
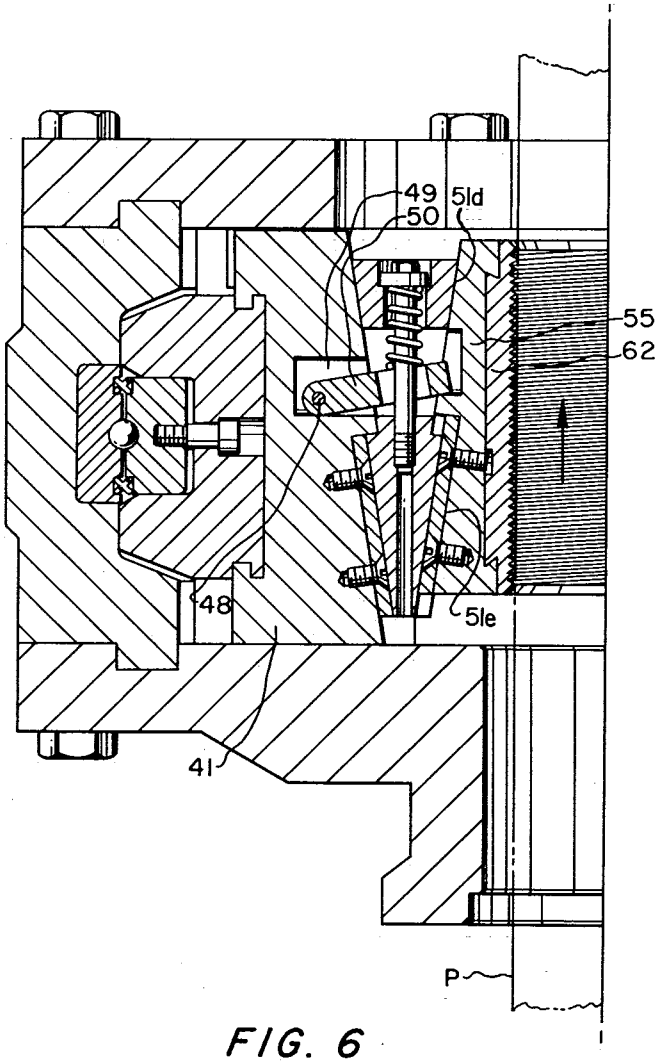
FIG. 6 shows grip tightening operation resulting from a pipe load up on the slip assembly.

Conversely, a small upward axial force on the gripped pipe sufficient to cause up movement of inserts 62 and slips 55 will lift pivoting bars 50, compress springs 61 and slide the slips upwardly and inwardly along secondary wedge surfaces 51*d* and 51*e*, causing deeper tooth into pipe penetration and greater grip as illustrated by FIG. 6. When axial pipe loading is removed from the gripping slip assembly or the assembly is not gripping pipe, the springs 61 bias the bars, secondary wedges and slips into the relative positions shown in FIG. 1.

When axial pipe loads up or down are sufficient to operate the slip systems to increase pipe grip, increased out forces resulting from increased in forces on gripped pipe are transmitted through slips, secondary wedges and camming segments, pressing the outer curved camming segment surfaces 30*d* out and to the bottom of ring segment grooves 21*c*. The curved surface contact areas and frictional forces generated therebetween acting through the radial distance to the axial center of the pipe passage are great enough to prevent the hydraulic actuator from rotating the camming segments and moving the wedges radially outward to release gripped pipe. In other words, the slip assembly of this invention cannot be operated hydraulically (either inadvertently or purposely) to release gripped pipe when gripping pressure applied to the hydraulic actuator is about 600 psi in combination with an axial pipe load of near 800 pounds, either up or down on the gripping slips.

Tests of the invention slip assembly revealed that varying the pressure applied to the hydraulic cylinder for gripping actuation caused proportionate variations in axial pipe loads necessary to produce out forces sufficient to prevent ungripping actuation and pipe release. Increased gripping pressures applied to the hydraulic cylinder required greater pipe loads to prevent the same applied pressure from releasing the pipe, and, conversely, decreasing applied gripping pressure required smaller pipe loads (less than 500–600 pounds) to prevent an ungripping pressure of 350–400 psi to release pipe. Such low actuation pressures were found not desirable, as they resulted in very slow movement of the slip assembly parts during operation.

What I claim is:

1. An improved hydraulically actuated double acting slip assembly comprising:

(a) housing means including a lower plate with a connector thereon and a passage for pipe therethrough, an upper plate with a passage for pipe therethough, and ring segments, each having a horizontal groove therein, positioned between said plates and around said pipe passages and connected to said plates;

(b) radial guiding means disposed in said housing means around said pipe passages;

(c) gripping means, slidably mounted in said guiding means for gripping pipe passing through said plate passages, including double acting slip means for gripping gripped pipe tighter, automatically actuated by thrust on gripped pipe sufficient to cause vertical movement of the gripped pipe including, wedges mounted in said guiding means, each wedge having a female 'T' slot across its outer surface and upper and lower downwardly and inwardly inclined surfaces on its inner face and a recess in the upper inclined surface, said recess having a lower planar surface, secondary wedges, mounted on said wedges, each having upper and lower downwardly and inwardly inclined surfaces on its outer face, engaging said wedge inclined surfaces, means slidably connecting said secondary wedges to said wedge for downward movement, each secondary wedge also having upper and lower downwardly and outwardly inclined surfaces on its inner face and a hole between said secondary wedge upper inclined surfaces on its inner and outer faces, said hole having a lower planar surface, slip means, mounted on said seconary wedges, including a slip having upper and lower downwardly and outwardly inclined surfaces on its outer face and a recess in said slip upper inclined surface, said recess having a lower planar surface and said slip inclined surfaces engaging said secondary wedge inner face inclined surfaces, means for slidably connecting said slip means to said secondary wedges for upward movement, a bar having a first hole therethrough, pivotally mounted in each wedge recess, and extending through the secondary wedge hole and into the slip recess, and biasing means, disposed in each secondary wedge, biasing said bar downwardly and aligning the lower planar surfaces of the wedge recess, the secondary wedge hole and slip recess, to position the secondary wedge and slip means in position for pipe grip tightening actuation;

(d) single cylinder actuating means for moving said gripping means inwardly and outwardly in said guiding means to grip and ungrip pipe; and (e) means preventing said actuating means from being actuated to release gripped pipe when thrust on gripped pipe has actuated said slip means.

2. The slip assembly of claim 1 wherein the radial guiding means are pairs of parallel plates extending upwardly from the housing means lower plate and downwardly from the upper plate, each pair positioned so that the centerline therebetween intersects the vertical centerline through said pipe passages.

3. The slip assembly of claim 1 wherein the actuating means are:

(a) one hydraulic cylinder, pivotally connected to the housing means lower plate, said cylinder having a rod extensible therefrom;

(b) a ring bearing, having an outer race mounted in the housing means segment horizontal grooves and an inner race;

(c) three camming segments, each having a groove in its outside surface for mounting on said bearing inner race and each being pivotally connected near one end and fastened to said inner race and each said segment also having a male 'T' slot on its inner surface, slidably engageable in each wedge outer surface female 'T' slot, slidably connecting each camming segment to each wedge; and (d) a link, pivotally connected on one end to said hydraulic cylinder rod and pivotally connected on its other end to one of said camming segments and said bearing inner race.

4. The slip assembly of claim 3 wherein the pipe release preventing means are an outward force on the camming segments resulting from automatic actuation of the slip means which develops frictional forces between the outer surface of the camming segments and the contacting groove bottom areas in each ring segment.

5. The slip assembly of claim 1 wherein the means slidably connecting the secondary wedges to the wedges are a male dovetail connected to the wedge lower inclined surface and engaged in a female dovetail in the secondary wedge lower inclined surface on its outer face.

6. The slip assembly of claim 1 wherein each slip means further include a slip insert having pipe gripping teeth on its inner surface and means connecting and retaining said insert to the inner surface of the slip.

7. The slip assembly of claim 6 wherein the means connecting and retaining the slip and slip inserts is a male dovetail on the outer surface of the slip insert, engaged in a female dovetail formed in the inner surface of the slip and retained by upper and lower screws connecting the male dovetail to the lower inclined surface of the slip, said upper screw protruding into a recess in the outer surface of the slip insert.

8. The slip assembly of claim 1 wherein the means for slidably connecting each slip means to each secondary wedge is a male dovetail connected to the lower inclined slip surface and engaged in a female dovetail in the lower secondary wedge inclined surface on its inner face.

9. The slip assembly of claim 1 wherein each bar is pivotally mounted in the recess in the wedge upper included surface on a pin passing through a hole through the wedge recess and through a second hole in the bar, near its outer end, said second hole being perpendicular to the first hole through the bar.

10. The slip assembly of claim 1 wherein the means biasing the bar downwardly are a spring, disposed around a bolt having a head, said bolt passes through the first hole through the bar and is fastened in each secondary wedge, so that the spring is compressed between said bolt head and the upper surface of the bar.

11. An improved hydraulically actuated double acting slip assembly for gripping pipe, comprising:

(a) a lower plate, having a connector thereon, a passage for pipe therethrough and pairs of parallel guide plates disposed around said passage and extending upwardly therefrom;

(b) one hydraulic actuating cylinder pivotally connected to said lower plate, said cylinder having a rod extensible therefrom;

(c) an upper plate, having a passage for pipe therethrough and pairs of parallel guide plates disposed around said passage and extending downwardly therefrom;

(d) ring segments, having horizontal grooves therein, disposed around said pipe passages and connected between said upper and lower plates;

(e) a ring bearing, having an outer race and an inner race, said outer race mounted in the grooves in said ring segments;

(f) camming segments, having outer grooves wherein said ring bearing inner race is mounted and each camming segment is pivotally connected and fastened to said inner race;

(g) wedges, slidably mounted for radial inward and outward movement between said guide plates and each said wedge slidably connected to a camming segment and having upper and lower downwardly and inwardly inclined surfaces on its inner face and a recess in the upper inclined surface, said recess having a lower planar surface;

(h) double acting slip system means, mounted on said wedges including secondary wedges having outer upper and lower inclined surfaces engaging said wedge inner face inclined surfaces and slidably connected to said wedges for downward movement, and upper and lower downwardly and outwardly inner inclined surfaces and a hole between said secondary wedge inner and outer upper inclinded surfaces, said hole having a lower planar surface, slips having pipe gripping inserts therein mounted on said secondary wedges, said slips having upper and lower downwardly and outwardly inclined outer face surfaces and a recess in the upper inclined surface, said recess having a lower planar surface, said slip outwardly inclined surfaces engaging said secondary wedge inner inclined surfaces, and means for slidably connecting said slips to said wedges for upward movement, a bar having a hole therethrough, pivotally mounted in each wedge upper inclined surface recess, said bar extending through the secondary wedge hole and into the slip upper inclined surface recess, a spring bias anchored in each secondary wedge, biasing the bar downwardly and aligning the lower surfaces of the wedge upper inclined surface recess, the secondary wedge hole and slip upper inclined surface recess, to position the secondary wedge and slips in position for pipe grip tightening actuation; and (i) a link, pivotally connected at one end to said actuating cylinder rod and pivotally connected at its other end to one of said camming segments and said bearing inner race.

12. An improved slip system, useful in slip asemblies for gripping pipe passing through the assembly, including a double acting slip automatically gripping pipe tighter when actuated by thrust on gripped pipe sufficient to cause vertical movement of the pipe, comprising:

(a) wedges mounted for pipe gripping movement in the assembly, each wedge having upper and lower downwardly and inwardly inclined surfaces on its inner face and a recess in the upper inclined surface, said recess having a lower planar surface;

(b) secondary wedges, mounted on said wedges, each having outer upper and lower inclined surfaces, engaging said wedge inner face inclined surfaces, means slidably connecting said secondary wedges to said wedges for downward movement, said secondary wedges having upper and lower downwardly and outwardly inner inclined sufaces and a hole between said secondary wedge inner and outer upper inclined surfaces, said hole having a lower planar surface;

(c) slip means, mounted on said secondary wedges including a slip having upper and lower downwardly and outwardly inclined surfaces on its outer face and a recess in said slip upper inclined surface, said recess having a lower planar surface and said slip inclined surfaces engaging said secondary wedge inner inclined surfaces, and means for slidably connecting said slip means to said secondary wedges for upward movement;

(d) a bar, having a first hole therethrough, pivotally mounted in each wedge upper inclined surface recess, extending through the secondary wedge hole and into the slip upper inclined surface recess; and (e) biasing means, disposed in each secondary wedge, biasing the bar downwardly and aligning the lower surfaces of the wedge upper inclined surface recess, the secondary wedge hole and slip upper inclined surface recess, to position the secondary wedge and slip means in position for pipe grip tightening actuation.

13. The slip system of claim 12 wherein the means slidably connecting the secondary wedges to the wedges are a male dovetail connected to the wedge lower inclined surface with upper and lower screws and engaged in a female dovetail in the secondary wedge outer lower inclined surface.

14. The slip system of claim 12 wherein each slip means further include a slip insert having pipe gripping teeth on its inner surface and means connecting and retaining said insert to the inner surface of the slip.

15. The slip system of claim 14 wherein the means connecting and retaining the slip and slip insert is a male dovetail on the outer surface of the slip insert, engaged in a female dovetail formed in the inner surface of the slip and retained by an upper screw connecting the male dovetail to the outer face of the slip, protruding into a hole in the outer surface of the slip insert.

16. The slip system of claim 12 wherein the means for slidably connecting each slip means to each secondary wedge is a male dovetail connected to the lower inclined slip surface and engaged in a female dovetail in the lower inner secondary wedge inclined surface.

17. The slip system of claim 12 wherein each bar is pivotally mounted in the recess in the wedge upper inclined surface on a pin passsing through a hole through the wedge recess and through a second hole in the bar, near its outer end, said second hole being perpendicular to the first hole through the bar.

18. The slip system of claim 12 wherein the means biasing the bar downwardly are a spring disposed around a bolt having a head, said bolt passes through the first hole through the bar and is fasfened in each secondary wedge, so that the spring is compressed between said bolt head and the upper surface of the bar.

* * * * *